US008881836B2

(12) United States Patent
Ingram

(10) Patent No.: US 8,881,836 B2
(45) Date of Patent: Nov. 11, 2014

(54) PACKING ELEMENT BOOSTER

(75) Inventor: Gary Duron Ingram, Richmond, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 90 days.

(21) Appl. No.: 11/849,281

(22) Filed: Sep. 1, 2007

(65) Prior Publication Data

US 2009/0056956 A1 Mar. 5, 2009

(51) Int. Cl.

| | |
|---|---|
| ***E21B 33/126*** | (2006.01) |
| ***E21B 23/01*** | (2006.01) |
| ***E21B 33/128*** | (2006.01) |
| ***E21B 33/1295*** | (2006.01) |

(52) U.S. Cl.

CPC ..... *E21B 33/1285* (2013.01); *E21B 33/1295* (2013.01)

USPC ..... 166/387; 166/179; 166/121; 166/212

(58) Field of Classification Search

USPC ..... 166/387, 179, 120, 191, 19

See application file for complete search history.

(56) References Cited

U.S. PATENT DOCUMENTS

| | | | | |
|---|---|---|---|---|
| 2,182,251 | A | 12/1939 | Crickmer et al. | |
| 2,222,014 | A | 11/1940 | Baker | |
| 2,228,242 | A * | 1/1941 | Baker | 166/134 |
| 2,519,116 | A | 8/1950 | Crake | |
| 2,656,891 | A | 10/1953 | Toelke | |
| 2,742,968 | A | 4/1956 | Hildebrandt | |
| 2,988,148 | A | 6/1961 | Conrad et al. | |
| 3,002,561 | A | 10/1961 | Baker et al. | |
| 3,011,555 | A | 12/1961 | Clark, Jr. | |
| 3,054,450 | A | 9/1962 | Baker | |
| 3,061,013 | A | 10/1962 | Thomas, Jr. | |
| 3,180,419 | A * | 4/1965 | Cochran et al. | 166/120 |
| 3,221,818 | A | 12/1965 | Taylor et al. | |
| 3,298,440 | A | 1/1967 | Current | |
| 3,339,637 | A | 9/1967 | Holden | |
| 3,361,209 | A | 1/1968 | Edwards, Jr. | |
| 3,374,840 | A | 3/1968 | Current | |
| 3,412,802 | A | 11/1968 | Kisling, III | |
| 3,456,723 | A | 7/1969 | Current et al. | |
| 3,459,261 | A | 8/1969 | Cochran | |
| 3,467,184 | A | 9/1969 | Young | |
| 3,507,327 | A | 4/1970 | Chenoweth | |
| 3,587,736 | A | 6/1971 | Brown | |

(Continued)

FOREIGN PATENT DOCUMENTS

| | | |
|---|---|---|
| EP | 0 237 662 | 9/1987 |
| EP | 0 959 226 | 11/1999 |
| FR | 2 377 518 | 8/1978 |
| GB | 1 398 038 | 6/1975 |

OTHER PUBLICATIONS

Australian Examination Report for Application No. 2008207450 dated Oct. 29, 2010.

(Continued)

*Primary Examiner* — James Sayre
(74) *Attorney, Agent, or Firm* — Patterson & Sheridan, LLP

(57) ABSTRACT

A packer is provided for sealing an annular region in a wellbore. In one embodiment, the, packer includes a boosting assembly adapted to increase a pressure on the packing element in response to an increase in a pressure surrounding the packer, for example, an increase in the annulus pressure.

34 Claims, 5 Drawing Sheets

(56) References Cited

U.S. PATENT DOCUMENTS

| | | | | |
|---|---|---|---|---|
| 3,603,390 | A | 9/1971 | McGill | |
| 3,623,551 | A | 11/1971 | Randermann, Jr. | |
| 3,678,998 | A | 7/1972 | Cockrell et al. | |
| 3,706,342 | A | 12/1972 | Woolley | |
| 3,872,295 | A | 3/1975 | Clancy | |
| 3,976,133 | A | 8/1976 | Allen | |
| 4,018,274 | A * | 4/1977 | Cochran | 166/129 |
| 4,044,826 | A | 8/1977 | Crowe | |
| 4,078,606 | A | 3/1978 | Montgomery | |
| 4,146,093 | A | 3/1979 | Horvath et al. | |
| 4,153,109 | A | 5/1979 | Szescila | |
| 4,216,827 | A | 8/1980 | Crowe | |
| 4,224,987 | A | 9/1980 | Allen | |
| 4,253,676 | A | 3/1981 | Baker et al. | |
| 4,289,200 | A | 9/1981 | Fisher, Jr. | |
| 4,300,775 | A | 11/1981 | Ringel | |
| 4,345,649 | A | 8/1982 | Baugh et al. | |
| 4,353,420 | A | 10/1982 | Miller | |
| 4,375,240 | A | 3/1983 | Baugh et al. | |
| 4,403,660 | A | 9/1983 | Coone | |
| 4,406,469 | A | 9/1983 | Allison | |
| 4,436,150 | A | 3/1984 | Barker | |
| 4,438,933 | A | 3/1984 | Zimmerman | |
| 4,444,252 | A | 4/1984 | Fisher, Jr. | |
| 4,452,463 | A | 6/1984 | Buckner | |
| 4,457,369 | A | 7/1984 | Henderson | |
| 4,487,258 | A | 12/1984 | Jackson et al. | |
| 4,499,947 | A | 2/1985 | Zsoka et al. | |
| 4,537,251 | A | 8/1985 | Braddick | |
| 4,540,047 | A | 9/1985 | Akkerman | |
| 4,554,973 | A | 11/1985 | Shonrock et al. | |
| 4,640,351 | A | 2/1987 | Clifton et al. | |
| 4,662,450 | A | 5/1987 | Haugen | |
| 4,708,202 | A | 11/1987 | Sukup et al. | |
| 4,730,670 | A | 3/1988 | Kim | |
| 4,749,035 | A | 6/1988 | Cassity | |
| 4,753,444 | A | 6/1988 | Jackson et al. | |
| 4,784,226 | A | 11/1988 | Wyatt | |
| 4,834,175 | A | 5/1989 | Ross et al. | |
| 4,898,239 | A | 2/1990 | Rosenthal | |
| 4,924,941 | A * | 5/1990 | Farley | 166/134 |
| 5,010,958 | A | 4/1991 | Meek et al. | |
| 5,044,441 | A | 9/1991 | Rubbo et al. | |
| 5,058,673 | A | 10/1991 | Muller et al. | |
| 5,103,901 | A | 4/1992 | Greenlee | |
| 5,165,703 | A | 11/1992 | Morvant | |
| 5,226,492 | A | 7/1993 | Solaeche et al. | |
| 5,226,494 | A | 7/1993 | Rubbo et al. | |
| 5,311,938 | A | 5/1994 | Hendrickson et al. | |
| 5,433,269 | A | 7/1995 | Hendrickson | |
| 5,542,473 | A | 8/1996 | Pringle et al. | |
| 5,620,050 | A | 4/1997 | Barbee | |
| 5,636,689 | A | 6/1997 | Rubbo et al. | |
| 5,676,384 | A | 10/1997 | Culpepper | |
| 5,678,635 | A | 10/1997 | Dunlap et al. | |
| 5,749,585 | A | 5/1998 | Lembcke | |
| 5,775,429 | A | 7/1998 | Arizmendi et al. | |
| 5,787,987 | A | 8/1998 | Forsyth et al. | |
| 5,810,082 | A * | 9/1998 | Jordan, Jr. | 166/120 |
| 5,819,846 | A | 10/1998 | Bolt, Jr. | |
| 5,819,854 | A | 10/1998 | Doane et al. | |
| 5,833,001 | A | 11/1998 | Song et al. | |
| 5,857,520 | A * | 1/1999 | Mullen et al. | 166/196 |
| 5,941,313 | A | 8/1999 | Arizmendi | |
| 6,009,951 | A | 1/2000 | Coronado et al. | |
| 6,041,858 | A | 3/2000 | Arizmendi | |
| 6,102,117 | A | 8/2000 | Swor et al. | |
| 6,116,339 | A | 9/2000 | Milne et al. | |
| 6,244,642 | B1 | 6/2001 | Serafin et al. | |
| 6,311,778 | B1 | 11/2001 | Carisella et al. | |
| 6,318,461 | B1 | 11/2001 | Carisella | |
| 6,354,372 | B1 | 3/2002 | Carisella et al. | |
| 6,823,945 | B2 | 11/2004 | Eslinger et al. | |
| 6,902,008 | B2 | 6/2005 | Hirth et al. | |
| RE38,866 | E | 11/2005 | Myhre | |
| 7,172,029 | B2 | 2/2007 | Hirth et al. | |
| 7,455,118 | B2 | 11/2008 | Roberts et al. | |
| 7,552,777 | B2 | 6/2009 | Murray et al. | |
| 2005/0155775 | A1 * | 7/2005 | Hirth et al. | 166/387 |
| 2008/0053652 | A1 * | 3/2008 | Corre et al. | 166/179 |
| 2008/0202771 | A1 | 8/2008 | Carisella et al. | |

OTHER PUBLICATIONS

EP Search Report for Application No. 08162980.0-1286 / 2031181 dated Apr. 21, 2010.

* cited by examiner

PACKING ELEMENT BOOSTER

BACKGROUND OF THE INVENTION

1. Field of the Invention

Embodiments of the present invention generally relate to completion operations in a wellbore. More particularly, the present invention relates to a packer for sealing an annular area between two tubular members within a wellbore. More particularly still, the present invention relates to a packer having a bi-directionally boosted and held packing element.

2. Description of the Related Art

During the wellbore completion process, a packer is run into the wellbore to seal off an annular area. Known packers employ a mechanical or hydraulic force in order to expand a packing element outwardly from the body of the packer into the annular region defined between the packer and the surrounding casing. In addition, a cone is driven behind a tapered slip to force the slip into the surrounding casing wall and to prevent packer movement. Numerous arrangements have been derived in order to accomplish these results.

A disadvantage with known packer systems is the potential for becoming unseated. In this regard, wellbore pressures existing within the annular region between an inner tubular and an outer casing string act against the setting mechanisms, creating the potential for at least partial unseating of the packing element. Generally, the slip used to prevent packer movement also traps into the packing element the force used to expand the packing element. The trapped force provides the packing element with an internal pressure. During well operations, a differential pressure applied across the packing element may fluctuate due to changes in formation pressure or operation pressures in the wellbore. When the differential pressure approaches or exceeds the initial internal pressure of the packing element, the packing element is compressed further by the differential pressure, thereby causing it to extrude into smaller voids and gaps or exceed the compression strength of the packing element, thereby resulting in a compression set of the packing element. Thereafter, when the pressure is decreased, the packing element begins to relax. However, the internal pressure of the packing element is now below the initial level because of the volume transfer and/or compression set of packing element during extrusion. The reduction in internal pressure decreases the packing element's ability to maintain a seal with the wellbore when a subsequent differential pressure is applied or when the direction of pressure is changed, i.e. top to bottom.

Therefore, there is a need for a packer system in which the packing element does not disengage from the surrounding casing under exposure to formation pressure. In addition, a packer system is needed in which the presence of formation pressure serves to further compress the packing element into the annular region, thereby assuring that formation pressure will not unseat the seating element. Further still, a packer system is needed to maintain the internal pressure at a higher level than the differential pressures across the packing element. Further still, a packer system is needed to boost the internal pressure of the packing element above the differential pressure across the packing element. Further still, a packer system is needed that can boost the internal pressure of the packing element with equal effectiveness from differential pressure above or below the packing element.

SUMMARY OF THE INVENTION

Embodiments of the present invention provide a packer for use in sealing an annular region in a wellbore. In one embodiment, the, packer includes a boosting assembly adapted to increase a pressure on the packing element in response to an increase in a pressure surrounding the packer, for example, an increase in the annulus pressure.

In one embodiment, the packer includes a boosting assembly adapted to increase the seal load on the packing element above the seal load applied during setting of the packing element.

In another embodiment, a packer includes a mandrel; a packing element disposed circumferentially around an outer surface of the mandrel; and a boosting assembly having a housing, a booster sleeve, and a pressure chamber defined by the housing and the booster sleeve, wherein the booster sleeve is movable toward the packing element to exert a force on the packing element and decrease the volume of the pressure chamber.

In another embodiment, a method of sealing a tubular in a wellbore includes placing a sealing apparatus in the tubular, wherein the sealing apparatus includes a mandrel; a packing element disposed circumferentially around an outer surface of the mandrel; and a boosting assembly having a housing, a booster sleeve, and a pressure chamber defined by the housing and the booster sleeve. The method also includes expanding the packing element into engagement with the tubular and applying a pressure to the booster sleeve, thereby causing the pressure chamber to reduce in size and the booster sleeve to move the booster sleeve axially to exert a force against the packing element.

In yet another embodiment, a method of isolating a zone in a wellbore includes providing a sealing apparatus having a first packer and a second packer, wherein at least one of the first packer and the second packer includes a mandrel; a packing element disposed circumferentially around an outer surface of the mandrel; and a boosting assembly having a housing, a booster sleeve, and a pressure chamber defined by the housing and the booster sleeve. The method also includes positioning the sealing apparatus in the wellbore such that the zone is between the first packer and the second packer; expanding the packing element the into engagement with the wellbore; and applying a pressure to the booster sleeve, thereby causing the pressure chamber to reduce in size and the booster sleeve to exert a force against the packing element. In yet another embodiment, the force exerted is greater than a force used to expand the packing element.

In yet another embodiment, a packer assembly for isolating a zone of interest includes a first packer coupled to a second packer, wherein at least one of the first packer and the second packer has a mandrel; a packing element disposed circumferentially around an outer surface of the mandrel; and a boosting assembly having a housing, a booster sleeve, and a pressure chamber defined by the housing and the booster sleeve, wherein the booster sleeve is movable toward the packing element to exert a force on the packing element and decrease the volume of the pressure chamber.

In one or more of the embodiments disclosed herein, the packer further includes a motion limiting member disposed between the housing and the booster sleeve.

In one or more of the embodiments disclosed herein, the packer further includes a packing cone member disposed between the boosting assembly and the packing element. In another embodiment, the packing cone member is selectively connected to at least one of the housing and the booster sleeve.

In one or more of the embodiments disclosed herein, the packer further includes a fluid path to communicate a pressure from the annulus to the booster assembly.

In one or more of the embodiments disclosed herein, the packer further includes a slip. In another embodiment, the slip is releasable after actuation.

In one or more of the embodiments disclosed herein, the packer further includes a slip cone member adapted to urge the slip radially outward.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
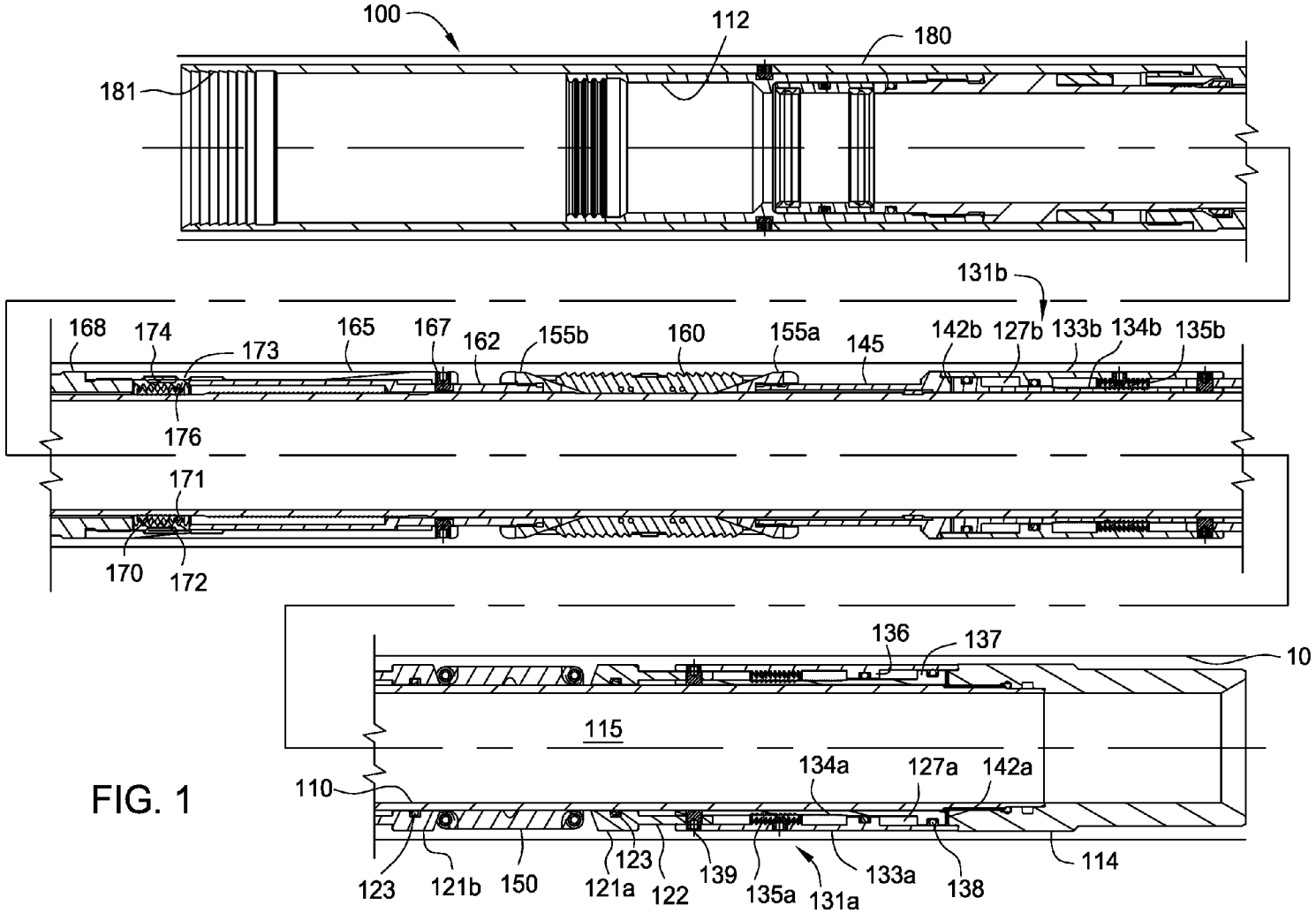
FIG. 1 is a cross sectional view one embodiment of the packer in the run-in position

FIG. 1 presents a cross-sectional view of an embodiment of a packer 100. The packer 100 has been run into a wellbore and positioned inside a string of casing 10. The packer 100 is designed to be actuated such that a seal is created between the packer 100 and the surrounding casing string 10. The packer 100 is run into the wellbore on a work string or other conveying member such as wire line.

The packer 100 includes a mandrel 110 which extends along a length of the packer 100. The mandrel 110 defines a tubular body that runs the length of the packer 100. As such, the mandrel 110 has a bore 115 therein for fluid communication, which may be used to convey fluids during various wellbore operations such as completion and production operations.

The mandrel 110 has an upper end 112 and a lower end 114. The upper end 114 may include connections for connecting to a setting tool or work string. The lower end 112 may be connected to a downhole tool which is located at an intermediate location from another downhole tool or is at a terminus position.

A packing element 150 resides circumferentially around the outer surface of the mandrel 110. The packing element 150 may be expanded into contact with the surrounding casing 10 in response to axial compressive forces generated by a packing cone 121*a,b* disposed on either side of the packing element 150. In this manner, the annular region between the packer 100 and the casing 10 may be fluidly sealed. Exemplary packing element materials include rubber or other elastomeric material. One advantage of this embodiment is that the through bore 115 for the packer 100 is maximized due to the configuration of the packing element 150 being disposed directly on the mandrel 110.

A packing cone 121*a,b* adapted to compress the packing element 150 is disposed on each side of the packing element 150. The cones 121*a,b* are slidably disposed on the mandrel 110 such that the cones 121*a,b* may move relative to each other, especially toward each other, in order to compress the packing element 150. The cones 121*a,b* may have an angled, straight, or curved contact surface with the packing element 150 to facilitate the expansion of the packing element 150 during compression. A seal ring 123 may be disposed between the packing cone 121*a,b* and the mandrel 110 to prevent fluid communication therebetween.

A booster assembly 131*a,b* is provided with each of the cones 121*a,b* and adapted to move the cones 121*a,b* toward the packing element 150. In one embodiment, the booster assembly 131*a,b* includes an outer housing sleeve 133*a,b* and an inner booster sleeve 134*a,b*, wherein the booster sleeve 134*a,b* is disposed between the outer housing sleeve 133*a,b* and the mandrel 110. A lock ring 135*a,b* may be used to couple the outer sleeve 133*a,b* to the booster sleeve 134*a,b*. The lock ring 135*a,b* is adapted to allow one way movement of the booster sleeve 134*a,b* relative to the outer sleeve 133*a,b*. In one embodiment, the lock ring 135*a,b* may include serrations for engagement with the housing sleeve 133*a,b* and the booster sleeve 134*a,b*. In must be noted that other forms of motion limiting device known to a person of ordinary skill may be used. A low pressure chamber 127*a,b* is defined between the housing sleeve 133*a,b* and the booster sleeve 134*a,b*. In one embodiment, each sleeve 133*a,b* and 134*a,b* is provided with a shoulder 136, 137 axially spaced from the other shoulder 136, 137. The shoulder 136 of one sleeve 134*a* is coupled to the other sleeve 133*a* using a sealing member 138 such as a seal ring. The pressure in the chamber 127*a,b* is preferably less than the pressure in the wellbore, and more preferably, is about atmospheric. In another embodiment, the booster assembly may be positioned adjacent the packing element without the use of the cone.

The housing sleeve 133*a,b* and the inner booster sleeve 134*a,b* may be selectively connected to the packing cone 121*a,b* using a shearable member 139 such as a shear screw. The shear rating of the shearable member 139 is selected such that it does not shear during run-in, but less than the setting force for the packer. In this respect, the shearable member 139 may serve to prevent premature or accidental setting of the packing element 150. In one embodiment, the packing cone 121*a,b* may include a protrusion member 122 at least partially disposed between the outer housing sleeve 133*a,b* and the booster sleeve 134*a,b*. After the connection 139 is broken, the protrusion member 122 may move relative to the sleeves 133, 134. In another embodiment, the protrusion member 122 may be releasably connected to the housing sleeve 133*a,b* only.

The lower booster assembly 131*a* is coupled to the lower end 114 of the packer 100 in a manner that allows a fluid path 142*a* to exist between the lower booster assembly 131*a* and the lower end 114 of the packer 100. In one embodiment, a portion of the housing sleeve 133*a,b* may overlap the lower end 114 of the packer 100, and the booster sleeve 134*a,b* is positioned adjacent the lower end 114. In this respect, fluid pressure in the annulus may be communication through the fluid path 142*a* and exert a force on the inner booster sleeve 134*a,b*. The upper booster assembly 131*b* may be similarly coupled to a connection sleeve 145, wherein fluid pressure in the annulus may be communicated through a fluid path 142*b* between the upper booster sleeve 134*a,b* and the connection sleeve 145 and exert a force on the upper booster sleeve 134*a,b*.

The packer 100 may further comprise an anchoring mechanism, such as one or more slips. In the illustrated embodiment, a pair of slip cones 155*a,b* disposed on each side of a slip 160 is coupled to the connection sleeve 145 on one side and a locking sleeve 162 on the other side. The pair of slip cones 155*a,b* may be moved toward each other to urge the slips 160 into engagement with the casing wall 10. In one embodiment, each slip cone 155*a,b* may have an angled contact surface in contact with the slips 160. As the cones 155*a,b* are moved toward each other, the angled surface may slide under a portion of the slips 160 thereby urging the slips 160 radially outward toward the casing wall 10.

The locking sleeve 162 is selectively connected to an extension sleeve 165 using a shearable connection 167. In turn, the extension sleeve 165 is connected to a coupling sleeve 168. A lock ring 170 is disposed between the locking sleeve 162 and the coupling sleeve 168. The lock ring 170 includes an inner body part 171 releasably coupled to an outer body part 172. The inner body part 171 includes serrations that mate with serrations on the mandrel 110. The serrations on the inner body part 171 are adapted to allow one way travel of the lock ring 170. A key and groove system is used to couple the outer body part 172 to the extension sleeve 165. As shown in FIG. 1, the keys 173 on the outer body part 172 are abutted against the keys 176 on the extension sleeve 165. In this position, the outer body part 172 is coupled to the inner body part 171. When the keys 173, 176 are in the grooves 174, the outer body part 172 is free to move outward, thereby releasing the outer body part 172 from the inner body part 171.

The coupling sleeve 168 is connected to an actuation sleeve 180. The actuation sleeve 180 may be actuated to exert a force in a direction toward the slips 160 to set the slips 160 and the packing element 150. The actuation sleeve 180 may also be actuated to exert a force in a direction away from the slips 160 to release the slips 160 from engagement with the casing wall 10. The actuation sleeve 180 may include a connection member 181 for connection to a work string or other actuation tool, for example, a spear.

Figure 2:
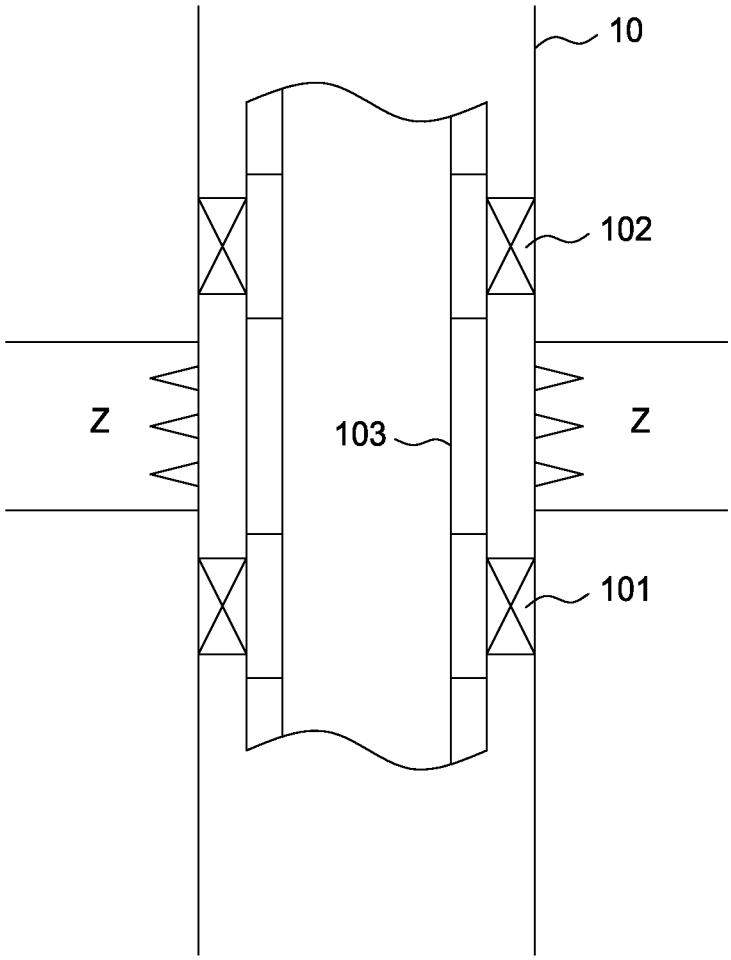
FIG. 2 is a schematic view of two packers isolating a zone of interest.

In one embodiment, one or more packers 100 may be coupled together for use in isolating a zone (Z). For example, two packers 101, 102 maybe used to straddle a zone (Z) of interest as shown in FIG. 2. A tubular body 103 may be disposed between the two packers 101, 102. The packers 101, 102 may be actuated at the same time or separately.

In operation, a first packer 101 is run into the wellbore and set at one end of the zone of isolation. The second packer 102 is then run into wellbore and connected to the first packer 101. If a tubular body 103 is used, the tubular body 103 is connected to a lower portion of the second packer 102 and connected to the first packer 101. The straddle is formed after the second packer 102 is set. It is contemplated that other actuation methods known of a person of ordinary skill may be used.

The operation of one packer 100 will now be described. After the packer 100 is positioned at the desired location, the packer 100 may be set by applying an axial compressive force. In one embodiment, the actuation force may be applied using a hydraulic setting tool, wherein the hydraulic setting tool connects to the mandrel 110 and the actuation sleeve 180. The hydraulic setting tool is operated to cause relative movement between the mandrel 110 and the actuation sleeve 180, thereby exerting the actuation force. In another embodiment, the packer may be run using a wireline with an electronic setting tool which uses an explosive power charge. The power charge creates the required relative movement between the mandrel 110 and the actuation sleeve 180.

Figure 3:
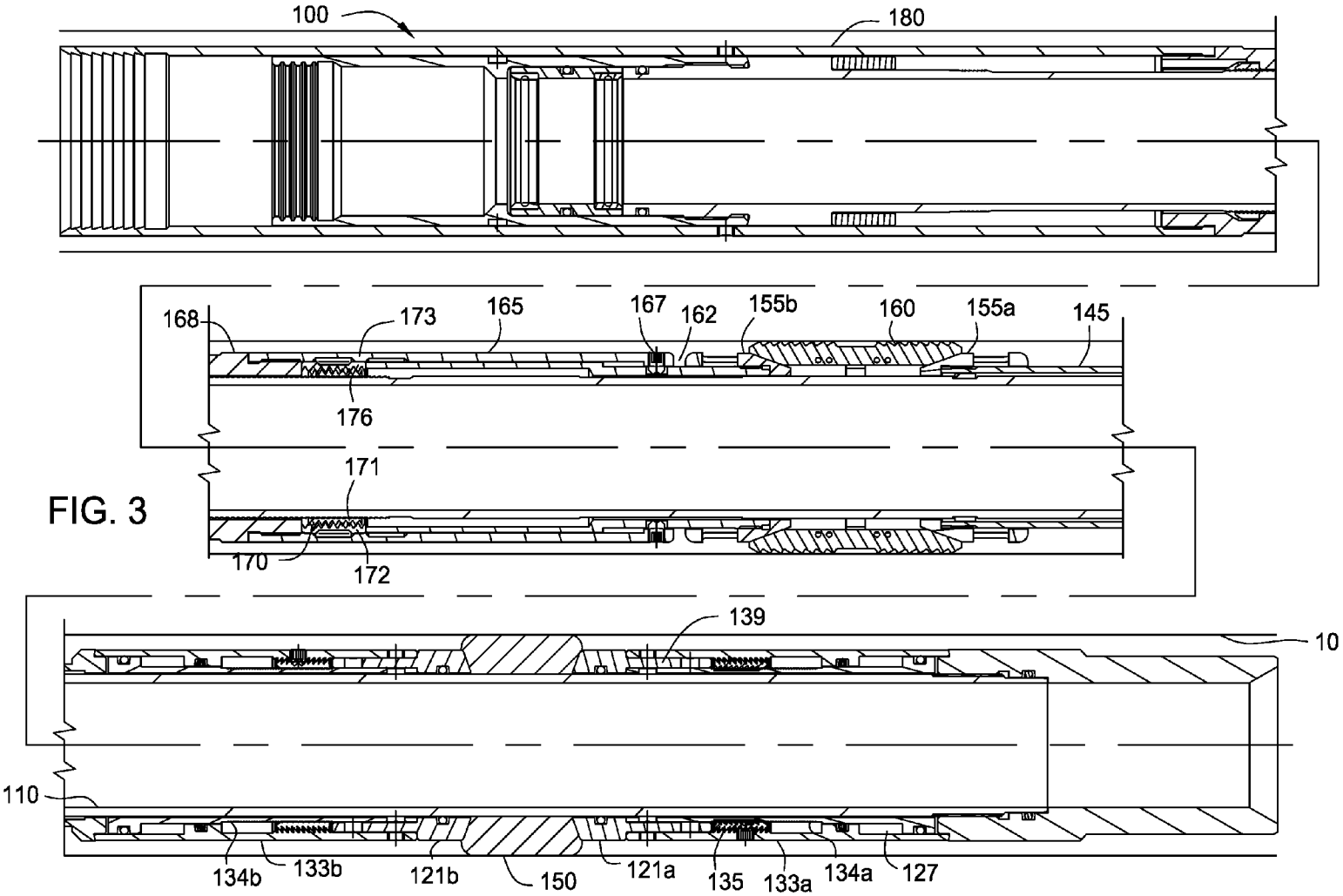
FIG. 3 is a cross sectional view of the packer in a pack off position.

When the actuation force is applied, downward movement of the actuation sleeve 180 causes the downward movement of the coupling sleeve 168, the lock ring 170, the extension sleeve 165, the locking sleeve 162, the cones 155*a,b*, the slips 160, and the connection sleeve 145, as shown in FIG. 3. The lock ring 170 has moved downward and the serrations on the inner body part 171 are engaged with the serrations on the mandrel 110 to prevent movement in the reverse direction. It can also be seen that the keys 173 of the outer body part 172 is abutted against the keys 176 of the extension sleeve 165. Also, the upper slip cone 155*b* has moved toward the lower slip cone 155*a* thereby urging the slips 160 to move outward and engage the casing wall 10.

The downward force applied also causes actuation of the packing element 150. In FIG. 3, the downward force applied shears the shearable connection 139 between the cones 121*a,b* and the outer housing sleeve 133*a,b* and the inner booster sleeve 134*a,b*. The cones 121*a,b* are free to move into abutment with the sleeves 133*a,b* and 134*a,b* and also move closer to each other. In this manner, the packing element 150 is compressed and deformed into sealing engagement with the casing wall 10. The serrations on the lock ring 135*a,b* cooperate with the serrations on the booster sleeve 134*a,b* to prevent the cones 121*a,b* from moving in a reverse direction. In this respect, the lock ring 135*a,b* assists in maintaining pressure on the packing element 150.

Figure 4:
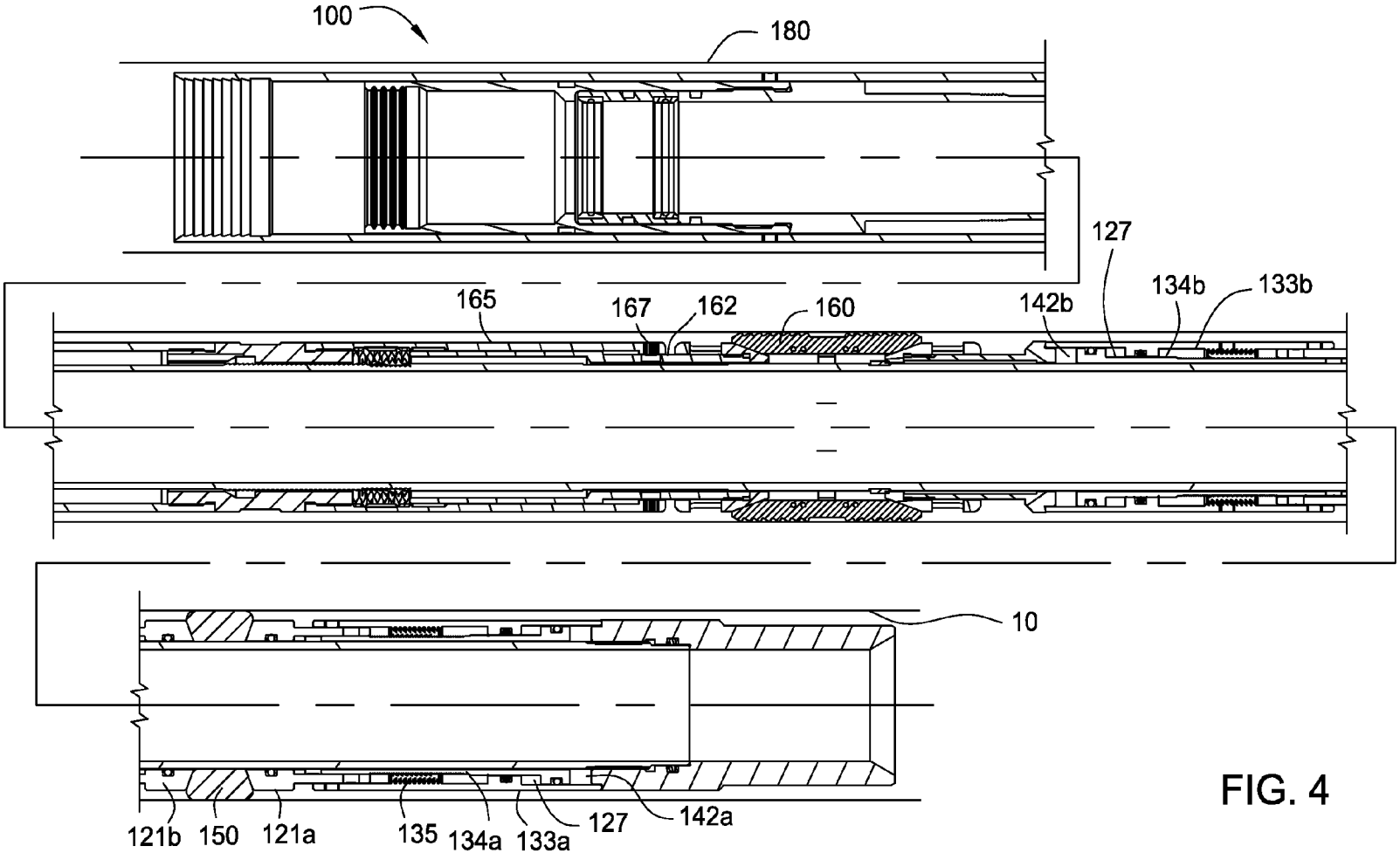
FIG. 4 is a cross sectional view of the packer in a boosted position.

During the life of the packer 100, pressure fluctuations in the wellbore may serve to boost the pressure on the packing element 150. Referring now to FIG. 4, an increase in the annulus pressure below the packing element 150 is communicated to the inner booster sleeve 134*a* of the packer 100 through the fluid path 142*a*. The annulus pressure exerts a force on the inner booster sleeve 134*a* which overcomes the internal pressure of the packing element 150. As shown in FIG. 4, the low pressure chamber 127*a* has decreased in size due to the movement of the booster sleeve 134*a* relative to the housing 133*a*. Also, the fluid path 142*a* adjacent the booster sleeve 134*a* has increased in size. As a result, the force exerted on the inner booster sleeve 134*a* moves the inner booster sleeve 134*a* and the abutting packing cone 121*a* toward the packing element 150, thereby increasing the pressure on the packing element 150. The movement of the booster sleeve 134*a* is locked in by the lock ring 135*a* and the pressure on the packing element 150 is maintained. Similarly, an increase on the other side of the packing element 150 would cause the booster sleeve 134*b* to apply an additional force on the packing element 150.

In another embodiment, the booster assembly of the packer may be used to increase the seal load of the packer. Typically, the initial seal load of the packing element is determined by the setting force from the setting tool. In some applications, such as small bore operations, the seal load applied by a standard setting tool may be less than optimal. In such situations, the booster assembly may advantageously function to further energized the packing element to a higher seal load, thereby maintaining the seal when the packer is exposed to a pressure greater than the set pressure.

In a straddle packer assembly, any increase in the pressure in the isolated zone may boost the pressure on the packing element 150 from the direction of the increased pressure. These pressure fluctuations may be natural or artificial. For example, referring to FIG. 2, chemicals or fluids may be selectively injected into one or more zones (Z) in the wellbore for treatment thereof. The chemicals or fluids may be a fracturing fluid, acid, polymers, foam, or any suitable chemical or fluid to be injected downhole. These injections may cause a temporary increase in the pressure of the wellbore, which may act on the packing elements 150 of the packers 101, 102. The pressure increase causes the booster assemblies of the straddle packers 101, 102 to boost the internal pressure of the respective packing elements 150. The boosted pressures of the packers 101, 102 are locked in even after the temporary pressure increase subsides, such as during a reverse flow of the injected fluids.

In another example, the booster assemblies of the packer may independently react to pressure changes. For example, referring again to FIG. 2, zone (Z) isolated by the straddle packers 101, 102 is not being produced when the zones above and below the isolated zone (z) are being produced. In this situation, the pressure in the producing zones may decrease, while the isolated zone may increase. This increase in pressure may act on the booster assemblies of the packers 101, 102 in the isolated zone. If the zone pressure is higher than the pressure of the seal load, the booster assemblies may react by increasing the seal load, thereby maintaining the seal to isolate the zone (Z). In this respect, the booster assemblies outside of the isolated zone (z) are not affected by the pressure change in the isolated zone (Z).

Figure 5:
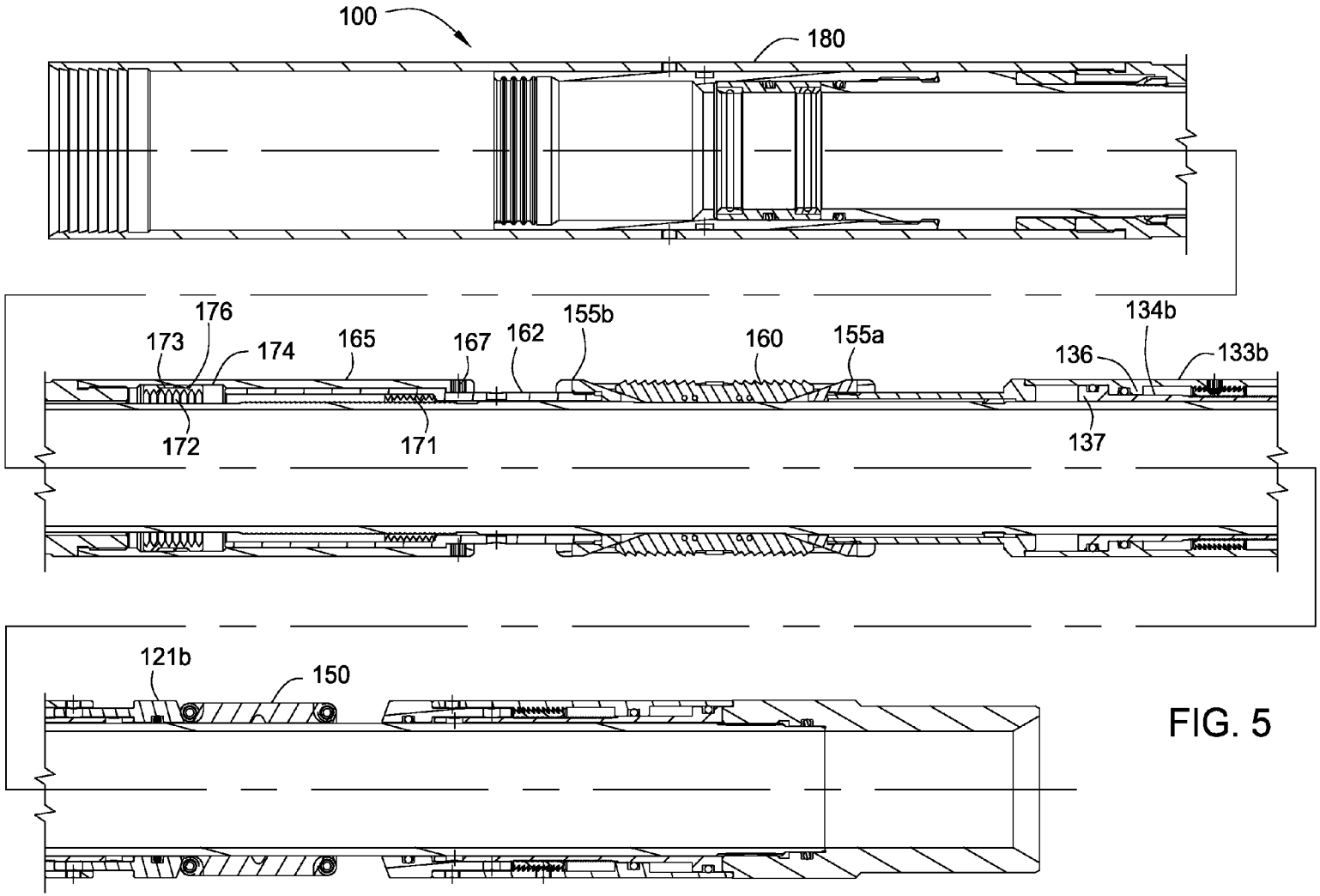
FIG. 5 is a cross sectional view of the packer in a released position.

The packer 100 may be retrieved after use. In one embodiment, a force in a direction away from the packing element 150 may be exerted on the actuation sleeve 180 to release the packer 100 for retrieval, as shown in FIG. 5. The packer release force may be applied by a spear or any other method known to a person of ordinary skill in the art. Upon application of the release force, the shearable connection 167 between the extension sleeve 165 and the locking sleeve 162 is broken. The extension sleeve 165 is move relative to the lock ring 170 such that the keys 173, 176 are positioned between the grooves 174. This position allows the outer body part 172 of the lock ring 170 to release from the inner body part 171, thereby unlocking the movement of the locking sleeve 162. As the locking sleeve 162 is pulled away by the extension sleeve 165, the cones 155*a,b* are also moved away from each other, which releases the slips 160 from engagement with the casing wall 100. The retrieval force also pulls the housing sleeve 133*b* of the upper booster assembly 131*b* away from the lower booster assembly 131*a*. The inner booster sleeve 134*b* also moves with the housing sleeve 133*b* due to the engagement of the shoulders 136, 137. As a result, the compression force applied by the cones 121*a,b* to the packing element 150 is removed, thereby allowing the packing element 150 to disengage from the casing wall 10 and return to a relaxed state. The packer 100 is now ready to be retrieved.

In another embodiment, the packer 100 is run into the wellbore along with various other completion tools. For example, a polished bore receptacle may be utilized at the top of a liner string. The top end of the packer 100 may be threadedly connected to the lower end of a polished bore receptacle, or PBR. The PBR permits the operator to sealingly stab into the liner string with other tools. Commonly, the PBR is used to later tie back to the surface with a string of production tubing. In this way, production fluids can be produced through the liner string, and upward to the surface.

Tools for conducting cementing operations are also commonly run into the wellbore along with the packer 100. For example, a cement wiper plug (not shown) will be run into the wellbore along with other run-in tools. The liner string will typically be cemented into the formation as part of the completion operation.

In another embodiment, the booster assembly may used with a slip assembly. In this respect, the booster assembly may react to pressure changes to maintain pressure sufficient for the slips to grip a contact surface such as casing.

While the foregoing is directed to embodiments of the present invention, other and further embodiments of the invention may be devised without departing from the basic scope thereof, and the scope thereof is determined by the claims that follow.

The invention claimed is:

1. A packer, comprising:

a mandrel;

a packing element disposed circumferentially around an outer surface of the mandrel; and a boosting assembly disposed on the outer surface of the mandrel, wherein the boosting assembly includes a housing, a booster sleeve, and a sealed pressure chamber defined by the housing and the booster sleeve, wherein the booster sleeve is movable toward the packing element in response to an external force to exert a force on the packing element and decrease a volume of the pressure chamber, and wherein the sealed pressure chamber is separated from the mandrel.

2. The packer of claim 1, further comprising a motion limiting member disposed between the housing and the booster sleeve.

3. The packer of claim 1, further comprising a packing cone member disposed between the boosting assembly and the packing element.

4. The packer of claim 3, wherein the packing cone member is selectively connected to at least one of the housing and the booster sleeve.

5. The packer of claim 3, further comprising a seal member disposed between the packing cone member and the mandrel.

6. The packer of claim 1, further comprising a fluid path to communicate the external pressure to the boosting assembly.

7. The packer of claim 6, wherein the force exerted corresponds to the external pressure.

8. The packer of claim 1, further comprising a second boosting assembly disposed on a side opposite the first boosting assembly, wherein the packing element is positioned between the first boosting assembly and the second boosting assembly.

9. The packer of claim 1, further comprising a slip.

10. The packer of claim 9, wherein the slip is releasable after actuation.

11. The packer of claim 9, further comprising a slip cone member adapted to urge the slip radially outward.

12. The packer of claim 9, wherein the slips are activated by a first force and the booster sleeve applies a second force to the slips.

13. The packer of claim 1, wherein the pressure chamber is at about atmospheric pressure.

14. The packer of claim 1, wherein the pressure chamber remains sealed during the operation of the packer.

15. The packer of claim 1, wherein the packing element is movable between an initially retracted position, an expanded position and a subsequently retracted position.

16. The packer of claim 15, wherein the pressure chamber is sealed when the packing element is in the subsequently retracted position.

17. The packer of claim 1, wherein the chamber is sealed using at least one sealing member disposed between the housing and the booster sleeve.

18. A method of sealing a tubular in a wellbore, comprising:

placing a sealing apparatus in the tubular, the sealing apparatus including:

a mandrel;

a packing element disposed circumferentially around an outer surface of the mandrel; and a boosting assembly disposed on the outer surface of the mandrel, wherein the boosting assembly includes a housing, a booster sleeve, and a pressure chamber enclosed by the housing and the booster sleeve, wherein the pressure chamber is isolated from a pressure in the wellbore;

expanding the packing element into engagement with the tubular while maintaining a size of the chamber; and applying a pressure to the booster sleeve, thereby causing the pressure chamber to reduce in size and move the booster sleeve axially to exert a force against the packing element.

19. The method of claim 18, further comprising placing a second packer in the tubular.

20. The method of claim 19, further comprising coupling the first packer and the second packer.

21. The method of claim 18, further comprising preventing the booster sleeve to move in an opposite axial direction.

22. The method of claim 18, further comprising providing a packing cone member disposed between the boosting assembly and the packing element.

23. The method of claim 22, further comprising releasably connecting the packing cone member to at least one of the housing and the booster sleeve.

24. The method of claim 18, further comprising providing a fluid path for communicating a pressure from the annulus to the boosting assembly.

25. The method of claim 24, wherein the pressure applied to the booster sleeve is the pressure communicated through the fluid path.

26. The method of claim 18, further comprising providing a second boosting assembly disposed on a side opposite the first boosting assembly, wherein the packing element is positioned between first boosting assembly and the second boosting assembly.

27. The method of claim 18, further comprising urging a slip toward the tubular.

28. The method of claim 27, further comprising releasing the slip and retrieving the sealing apparatus.

29. The method of claim 18, further comprising retracting the packing element such that the packing element moves out of engagement with the tubular, wherein the pressure chamber is isolated from the pressure in the wellbore during the operation of the sealing apparatus.

30. The method of claim 18, wherein the pressure chamber is isolated from the pressure in the wellbore using at least one sealing member disposed between the housing and the booster sleeve.

31. A method of isolating a zone in a wellbore, comprising:

providing a sealing apparatus having a first packer and a second packer, wherein at least one of the first packer and the second packer includes:

a mandrel;

a packing element disposed circumferentially around an outer surface of the mandrel; and a first boosting assembly and a second boosting assembly, wherein each of the first and second boosting assemblies include a housing, a booster sleeve, and a pressure chamber enclosed by the housing and the booster sleeve, wherein the pressure chamber is isolated from a pressure in the wellbore;

positioning the sealing apparatus in the wellbore such that the zone is between the first packer and the second packer;

moving the first boosting assembly relative to the mandrel to expand the packing element into engagement with the wellbore; and applying a pressure to the booster sleeve of the first boosting assembly, thereby causing the pressure chamber of the first boosting assembly to reduce in size and causing the booster sleeve of the first boosting assembly to exert a force against the packing element, wherein the first boosting assembly and the second boosting assembly are actuated by applying pressure from opposite directions.

32. The method of claim 31, further comprising retracting the packing element such that the packing element moves out of engagement with the tubular, wherein the pressure chamber is isolated from the pressure in the wellbore while retracting the packing element.

33. A method of isolating a zone in a wellbore, comprising:

providing a sealing apparatus having a first packer and a second packer, wherein at least one of the first packer and the second packer includes:

a mandrel;

a packing element disposed circumferentially around an outer surface of the mandrel; and a boosting assembly having a housing, a booster sleeve, and a pressure chamber enclosed by the housing and the booster sleeve, wherein the pressure chamber is isolated from a pressure in the wellbore;

positioning the sealing apparatus in the wellbore such that the zone is between the first packer and the second packer;

expanding the packing element into engagement with the wellbore without changing a size of the pressure chamber; and applying a pressure to the booster sleeve, thereby causing the pressure chamber to reduce in size and causing the booster sleeve to exert a force against the packing element, wherein the force exerted is greater than a force used to expand the packing element.

34. A packer, comprising:

a mandrel;

a packing element disposed circumferentially around an outer surface of the mandrel; and a boosting assembly disposed on the outer surface of the mandrel, wherein the boosting assembly includes a housing, a booster sleeve, and a sealed pressure chamber defined by the housing and the booster sleeve, wherein the booster sleeve is movable toward the packing element in response to an external force to exert a force on the packing element and decrease a volume of the pressure chamber, wherein the packing element is actuatable while maintaining a size of the pressure chamber.

* * * * *